US009666978B2

(12) United States Patent
Fernandez et al.

(10) Patent No.: US 9,666,978 B2
(45) Date of Patent: May 30, 2017

(54) CABLE CLAMPING SYSTEM FOR STRAIN RELIEF AND GROUNDING

(71) Applicant: Rockwell Automation Technologies, Inc., Mayfield Heights, OH (US)

(72) Inventors: Juan Fernandez, Brown Deer, WI (US); Jeffrey Dujmovic, Milwaukee, WI (US); Brijeshkumar Meghpara, Germantown, WI (US); Eric Krieg, Cedarburg, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 14/709,049

(22) Filed: May 11, 2015

(65) Prior Publication Data

US 2016/0336683 A1 Nov. 17, 2016

(51) Int. Cl.
*H01R 13/58* (2006.01)
*H01R 13/6592* (2011.01)

(52) U.S. Cl.
CPC ..... *H01R 13/5804* (2013.01); *H01R 13/6592* (2013.01)

(58) Field of Classification Search
None
See application file for complete search history.

(56) References Cited

U.S. PATENT DOCUMENTS 1,957,462 A 5/1934 Kress
5,597,331 A * 1/1997 Gable ..... H01R 11/287 439/504
5,601,260 A * 2/1997 Shinohara ..... F16B 21/088 248/68.1
5,941,483 A * 8/1999 Baginski ..... F16L 3/22 248/68.1
5,992,802 A * 11/1999 Campbell ..... H02G 3/30 248/68.1
6,241,200 B1 * 6/2001 Camporeale ..... F16L 3/223 248/68.1
7,007,900 B2 * 3/2006 Goodwin ..... H02G 7/053 248/68.1
7,223,119 B2 * 5/2007 Droesbeke ..... H01R 13/562 439/456
7,514,630 B2 * 4/2009 Anderson ..... H02G 3/30 174/135
7,553,279 B1 * 6/2009 Phillips ..... F16B 2/185 248/229.2
7,657,985 B2 * 2/2010 McClure ..... B23K 31/02 248/68.1

(Continued)

*Primary Examiner* — Xanthia C Cunningham
(74) *Attorney, Agent, or Firm* — Fay Sharpe LLP

(57) ABSTRACT

An electronics module includes a cable clamp chassis projecting outward from a wall of the module. The cable clamp chassis includes first and second cable mounting locations adapted to receive respective first and second cables. The cable mounting locations each include an axially extending recess located adjacent a first reference plane. Each of the cable mounting locations includes an inner surface with an innermost point that lies tangent to a second reference plane that is parallel to and offset from the first reference plane such that the first and second cables are arranged in a zero stack configuration. A clamp is secured to the cable clamp chassis and adapted to secure the first and second associated cables in the first and second cable receiving locations.

19 Claims, 9 Drawing Sheets

(56) References Cited

U.S. PATENT DOCUMENTS 7,780,461 B1 * 8/2010 Vernica ..... H01R 4/36 439/100
8,063,317 B2 * 11/2011 Bowman ..... H02G 3/185 174/480
8,092,248 B2 * 1/2012 Van Stiphout ..... H01R 43/16 439/464
8,721,689 B2 * 5/2014 Butler ..... A61B 17/7052 606/252
8,756,866 B2 * 6/2014 Lee ..... E06B 3/5481 49/375
8,777,643 B2 * 7/2014 De France ..... H01R 9/0524 174/78
8,821,173 B2 * 9/2014 Carnevali ..... G06F 1/1632 361/679.41
2003/0108385 A1 * 6/2003 Finco ..... H02G 3/0443 403/396
2003/0162435 A1 * 8/2003 Holman ..... H01R 13/5812 439/466
2006/0064093 A1 * 3/2006 Thramann ..... A61B 17/7052 74/1 R
2007/0066101 A1 * 3/2007 Suzuki ..... H02G 3/32 439/99
2007/0167087 A1 * 7/2007 Tamm ..... H01R 4/36 439/798
2010/0043297 A1 * 2/2010 Barr ..... E05F 11/385 49/375
2010/0054689 A1 * 3/2010 Mullaney ..... G02B 6/4477 385/135
2010/0136822 A1 * 6/2010 Van Stiphout ..... H01R 43/16 439/470
2011/0081800 A1 * 4/2011 Heise ..... H01R 9/032 439/460
2011/0265290 A1 * 11/2011 Carnevali ..... F16B 2/08 24/326
2011/0303456 A1 * 12/2011 Blanchard ..... F16L 3/1091 174/480
2011/0315830 A1 * 12/2011 Eshima ..... H02G 3/32 248/74.1
2012/0112014 A1 * 5/2012 Eshima ..... H02G 3/32 248/68.1
2012/0230646 A1 * 9/2012 Thompson ..... G02B 6/4477 385/135
2013/0020123 A1 * 1/2013 Ruth ..... H02G 3/32 174/480
2014/0014407 A1 1/2014 Krieg et al.

* cited by examiner

CABLE CLAMPING SYSTEM FOR STRAIN RELIEF AND GROUNDING

BACKGROUND

Motor drives and other electronics modules require cable strain relief and cable EMI/RFI shield grounding for secure connection of the associated cable to the module and for establishing a low impedance ground path to a desired ground location. Many structures are known for providing the required strain relief and ground path.

Known systems have been found to be suboptimal with respect to the physical location of the cables in cases where more than one cable must be connected to the module, especially when used in connection with a narrow module, which can lead to the multiple cables being positioned undesirably outside of the width of the module where they can interfere with cables of adjacent modules, present an obstacle for mounting of an adjacent module, and generally detract from the proper mounting an installation of the module and its associated cables or adjacent modules and the associated cables thereof.

Another drawback of known cable strain relief and grounding arrangements is that the cable clamping structures for operatively securing the cable(s) to the chassis of the electronics module are sometimes difficult to use, require special tools, are subject to loss of parts, do not work well when cables of different sizes must be accommodated or when some cables are omitted, or have been found to be too complex and/or expensive.

In light of the foregoing issues and others associated with known cable strain relief and grounding systems for electronics modules, a need has been identified for a new and improved electronics module cable clamping system for strain relief and grounding.

SUMMARY

In accordance with one aspect of the present development, an electronics module includes left and right side walls and a bottom wall that extends between the left and right side walls. The module also includes an electrically conductive cable clamp chassis projecting outward from the bottom wall of the module. The cable clamp chassis comprises first and second cable mounting locations adapted to receive respective first and second associated cables. The first and second cable mounting locations are arranged in a zero stack configuration in which the first and second cable mounting locations are centered on a common reference plane P located between and parallel to the left and right side walls such that the respective longitudinal axes of the first and second associated cables are both located within said reference plane P. First and second cable clamps are secured to the cable clamp chassis respectively adjacent the first and second cable mounting locations and are respectively adapted to secure the first and second associated cables in the first and second cable mounting locations with an EMI shield of each associated cable electrically connected to the cable clamp chassis.

In accordance with another aspect of the present development, an electronics module includes a cable clamp chassis projecting outward from a wall of the module. The cable clamp chassis comprises first and second cable mounting locations adapted to receive respective first and second associated cables. The first and second cable mounting locations each include an axially extending recess located adjacent a first reference plane. Each of the first and second cable mounting locations includes an inner surface with an innermost point that lies tangent to a second reference plane that is parallel to and offset from the first reference plane such that the first and second cables are arranged in a zero stack configuration. A clamp is secured to the cable clamp chassis and adapted to secure the first and second associated cables in the first and second cable receiving locations.

DETAILED DESCRIPTION

Figure 1B:
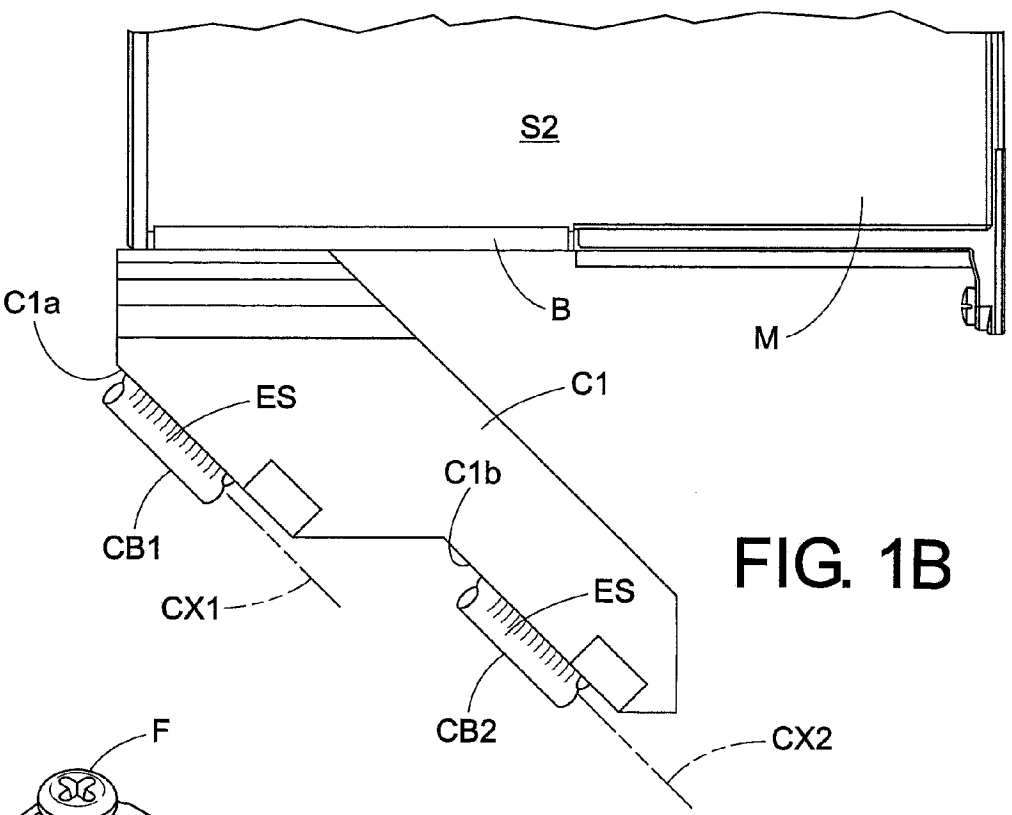
FIGS. 1A and 1B are respective partial front and right side views of an electronics module including a first embodiment of a cable clamp chassis in accordance with the present development.
Figure 1C:
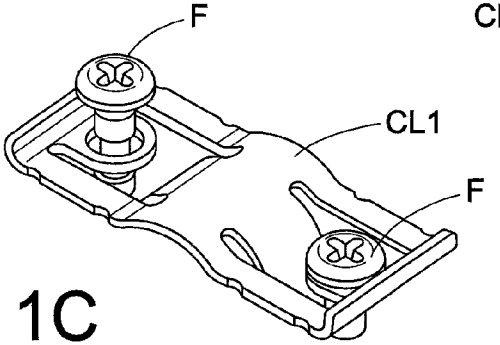
FIG. 1C illustrates a known cable clamp to be used with the cable clamp chassis of FIGS. 1A and 1B.
Figure 1A:
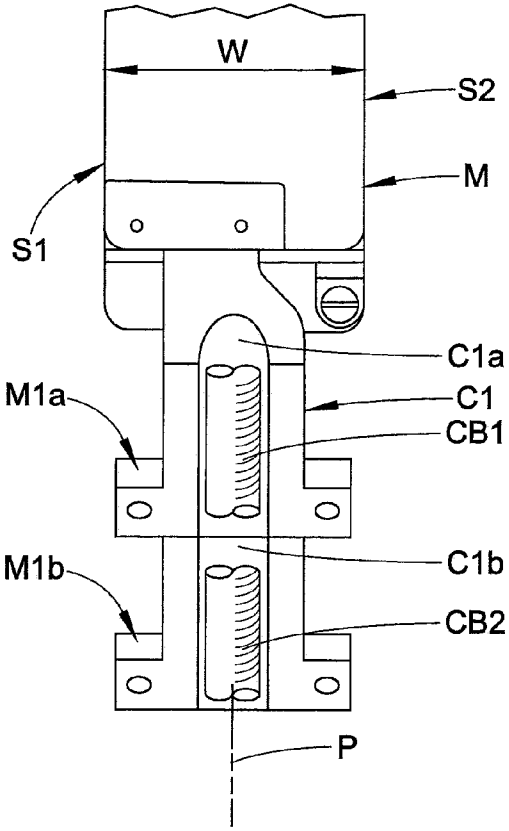

FIGS. 1A and 1B are respective partial front and right side views of an electronics module M including a first embodiment of a cable clamp chassis C1 in accordance with the present development. The module M can be any type of enclosure or mounting structure defining an internal space or other location for mounting electronic components thereto.

As shown herein, the module M comprises a motor drive module, but is not intended to be limited to same.

The module M includes a cable clamp chassis C1 according to a first embodiment and to which at least one cable CB1,CB2 is secured when the cable is electrically connected to the circuitry contained in the module M. The clamp chassis C1 is defined as a metallic structure such as a casting or other structure that is connected to and projects outwardly or downwardly from a bottom side or bottom wall B of the module M. The bottom wall B extends between left and right side walls S1,S2 of the module M. In one embodiment, the clamp chassis comprises a one-piece zinc die-casting, but other materials and structures are contemplated. The clamp chassis C1 is provided to secure the one or more cables to the module M for providing strain relief to prevent pulling forces on the cable from being transmitted to the electrical coupling of the cable to the module M, and to electrically connect with the electrical magnetic interference (EMI) and/or radio frequency interference (RFI) shield (the EMI and/or RFI shield is referred to generally herein as an "EMI shield") of the cables to provide a ground path to a desired location through the clamp chassis C1 and module M.

The module M defines a lateral width W between its left and right side walls S1,S2, and the multiple modules M are often mounted in series with the right side wall S2 of a first module abutted or adjacent the left side wall S1 of a second module. Such an arrangement is complicated if the cables connected to each module are arranged in a row that extends laterally between the side walls S1,S2, as cables on the opposite ends of the row will often protrude beyond the side walls S1,S2 and interfere with the adjacent module. According to one aspect of the present development, however, the clamp chassis C1 restrains the cables CB1,CB2 in a "zero stack" configuration. More particularly, the clamp chassis C1 includes at least first and second (and optionally three or more) cable receiving or cable mounting locations C1*a*,C1*b* that are dimensioned and otherwise adapted to receive respective first and second cables CB1,CB2. As illustrated herein, each cable receiving location C1*a*,C1*b* comprises an axially extending recess with its surface preferably defined by a circular arc segment. The cable mounting locations C1*a*,C1*b* are centered on a common reference plane P that extends parallel to the left and right sidewalls S1,S2 such that the cables CB1,CB2 respectively located therein are likewise centered on the plane P, i.e., the respective origins of the circular arc segments defining each surface C1*a*,C1*b* are located in the plane P such that the longitudinal axis CX1,CX2 of each cable CB1,CB2 lies in the plane P and such that the reference plane P bisects the circular arc segment surfaces of the first and second cable mounting locations C1*a*,C1*b*. The plane P preferably lies roughly midway between the left and right sidewalls S1,S2. With the two or more cables CB1,CB2 aligned in a single plane P, the cables CB1,CB2 are located where they will not interfere with adjacent modules or the cables associated with same.

FIG. 1C illustrates a known clamp CL1 that is used to secure the cables CB1,CB2 in their respective receiving locations C1*a*,C1*b*, with a first one of the clamps CL1 secured via fasteners F to a first mounting location M1*a* located adjacent the first cable receiving location C1*a*, and with a second one of the clamps CL1 secured via fasteners F to a second mounting location M1*b* located adjacent the second cable receiving location C1*b*. The structure and operation of the clamp CL1 is described more fully in commonly owned U.S. Patent App. Pub. 2014/0014407 A1, the entire disclosure of which is hereby expressly incorporated by reference into the present specification. The outer electrical insulation of the cables CB1,CB2 is removed in the region where the cables CB1,CB2 are respectively seated in the cable receiving locations C1*a*,C1*b* to expose an electrically conductive sheath ES such that the sheath ES is electrically connected to the clamp chassis C1 and the clamp CL1 for conducting electrical interference in the sheath ES to a ground path of the module M through the clamp chassis C1.

Figure 2B:
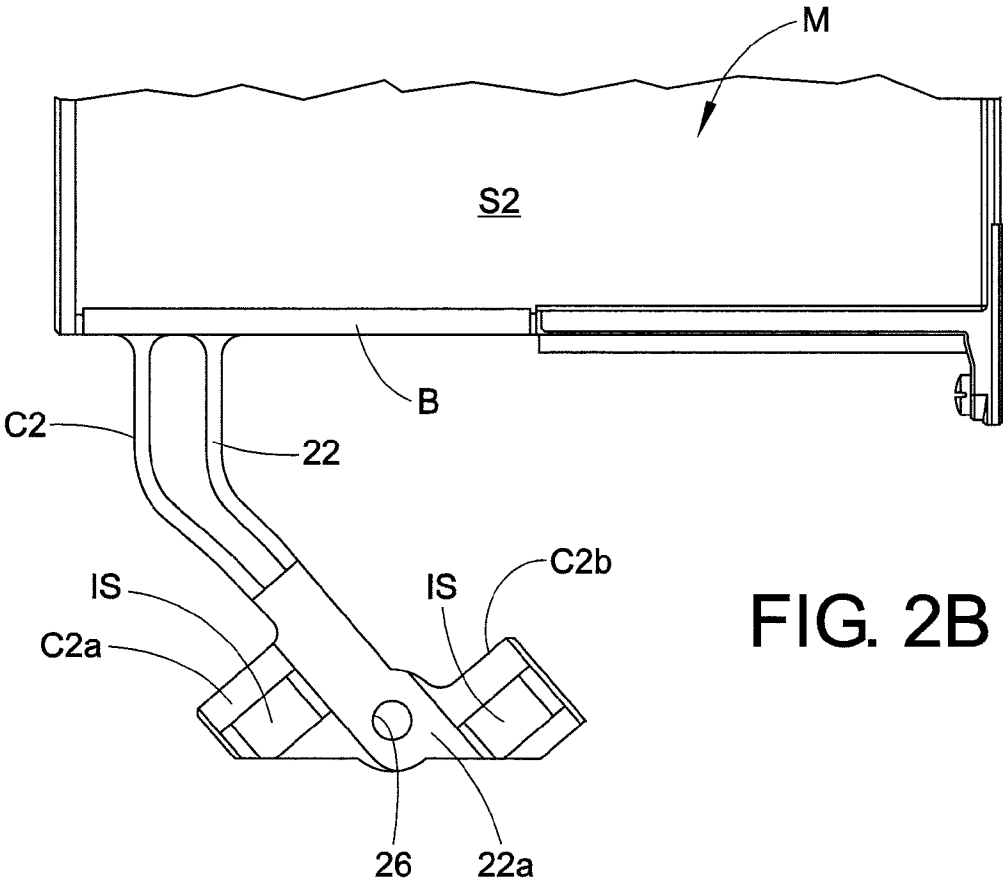
FIGS. 2A and 2B are respective partial front and right side views of an electronics module including a second embodiment of a cable clamp chassis in accordance with the present development.
Figure 2A:
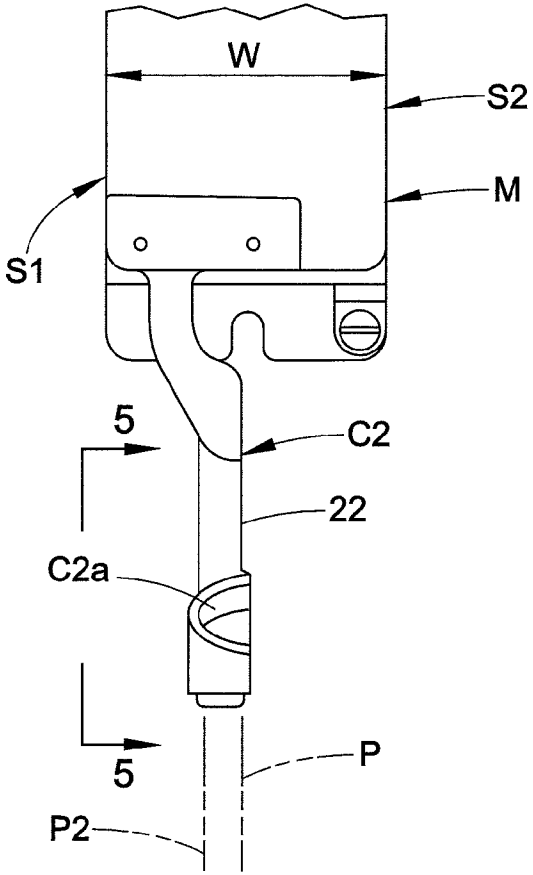

FIGS. 2A and 2B are respective partial front and right side views of an electronics module M including a second embodiment of a cable clamp chassis C2 in accordance with the present development and to which at least one cable CB1,CB2 is secured when the cable is electrically connected to the circuitry contained in the module M. The clamp chassis C2 also provides a zero stack cable mounting arrangement for strain relief and grounding as described above for the cable clamp chassis C1.

The clamp chassis C2 is also defined as a metallic structure such as a casting or other structure that is connected to and projects outwardly or downwardly from a bottom side B of the module M. In one embodiment, the clamp chassis C2 comprises a one-piece zinc die-casting, but other materials and structures are contemplated. The clamp chassis C2 is provided to secure the one or more cables to the module M for providing strain relief to prevent pulling forces on the cable from being transmitted to the electrical coupling of the cable to the module M, and to electrically connect with the electrical magnetic interference/radio frequency interference (EMI/RFI) shield ES of the cable to provide a ground path to a desired location through the clamp chassis C2.

The clamp chassis C2 includes at least first and second (and optionally three or more) cable receiving or cable mounting locations C2*a*,C2*b* that are dimensioned and otherwise adapted to receive respective first and second cables CB1,CB2. The first and second cables CB1,CB2 (FIG. 3) include respective longitudinal axes CX1,CX2. As illustrated herein, each cable receiving location C2*a*,C2*b* comprises an axially extending recess with its inner surface comprising a circular arc segment, although the recess can have a non-cylindrical surface such as an ovalized surface or a polygonal surface, or any combination of surfaces.

The cable mounting locations C2*a*,C2*b* are located adjacent a common first reference plane P that extends parallel to the left and right sidewalls S1,S2 such that the cables CB1,CB2 respectively located in the receiving locations C2*a*,C2*b* are centered on the plane P, i.e., the longitudinal axis of each cable CB1,CB2 lies in the plane P. The first plane P preferably lies approximately midway between the left and right sidewalls S1,S2. With the two or more cables CB1,CB2 aligned in a single first plane P, the cables CB1, CB2 are located where they will not interfere with adjacent modules or the cables associated with same.

Each cable receiving location C2*a*,C2*b* includes an inner surface IS (see also FIG. 4) that abuts a cable CB1,CB2 located therein, and the innermost point on each inner surface IS, in terms of the depth of the cable receiving location C2*a*,C2*b*, is tangent to a common second reference plane P2 that lies parallel to but is offset from the first reference plane P by a distance equal to half the maximum diameter of the cables CB1,CB2 to be accommodated which locates the axis of each cable CB1,CB2 in the reference plane P. As described more fully below and as shown in FIG. 3, the outer electrical insulation of the cables CB1,CB2 is removed in the region where the cables CB1,CB2 are respectively seated in the cable receiving locations C2*a*,C2*b* to expose an electrically conductive sheath ES of the cable such that the cable sheath ES is electrically connected to the clamp chassis C2 for conducting electrical interference in the cable sheath ES to a ground path of the module M through the clamp chassis C2.

Figure 3:
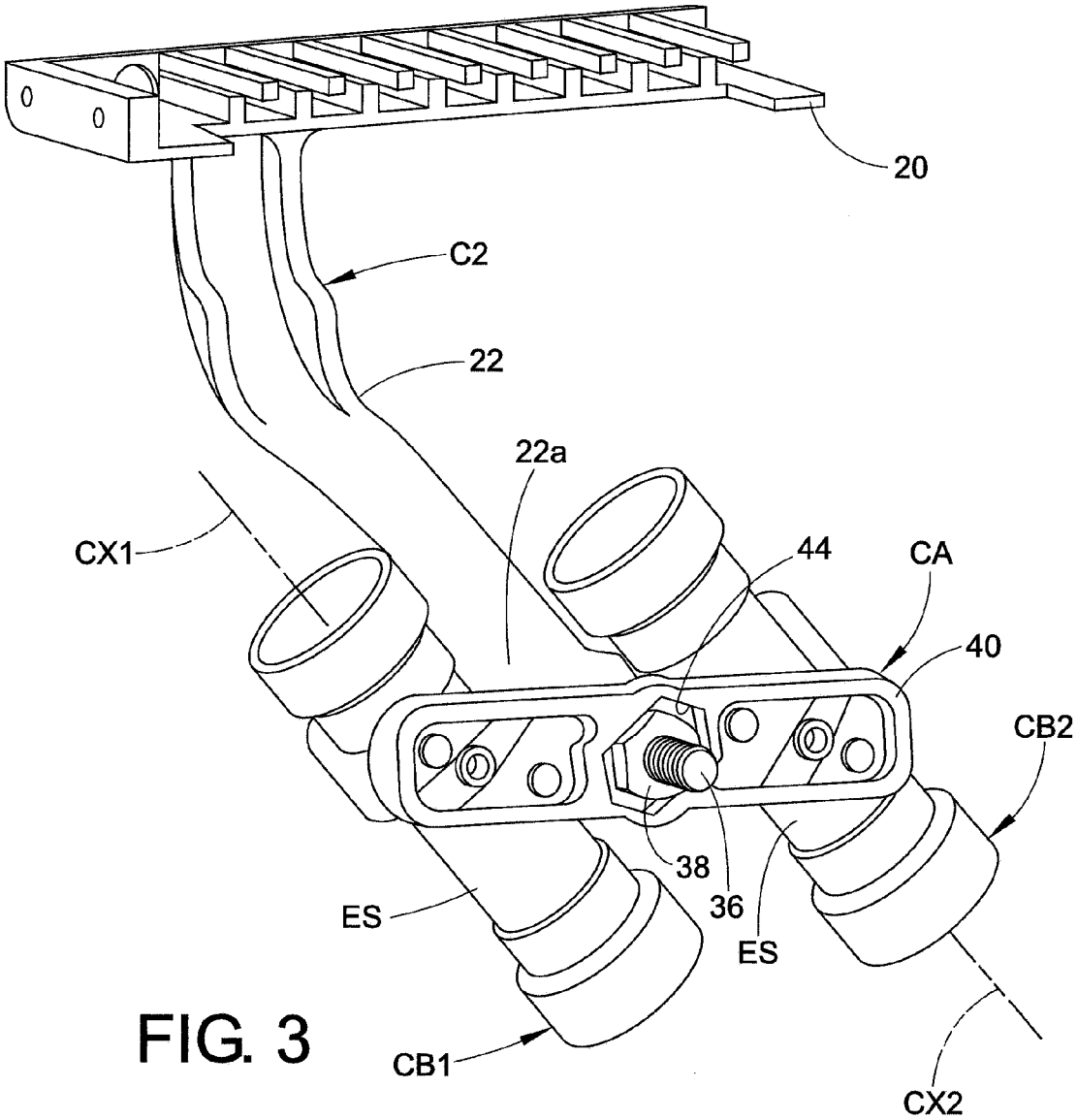
FIG. 3 is an isometric view of the chassis of FIGS. 2A and 2B, separated from the module M, and further including a clamp in accordance with the present development operatively secured thereto to provide a clamp assembly for in accordance with an embodiment of the present development (FIG. 3 also shows portions of first and second associated cables operatively secured by the clamp assembly to provide strain relief and grounding)
Figure 4:
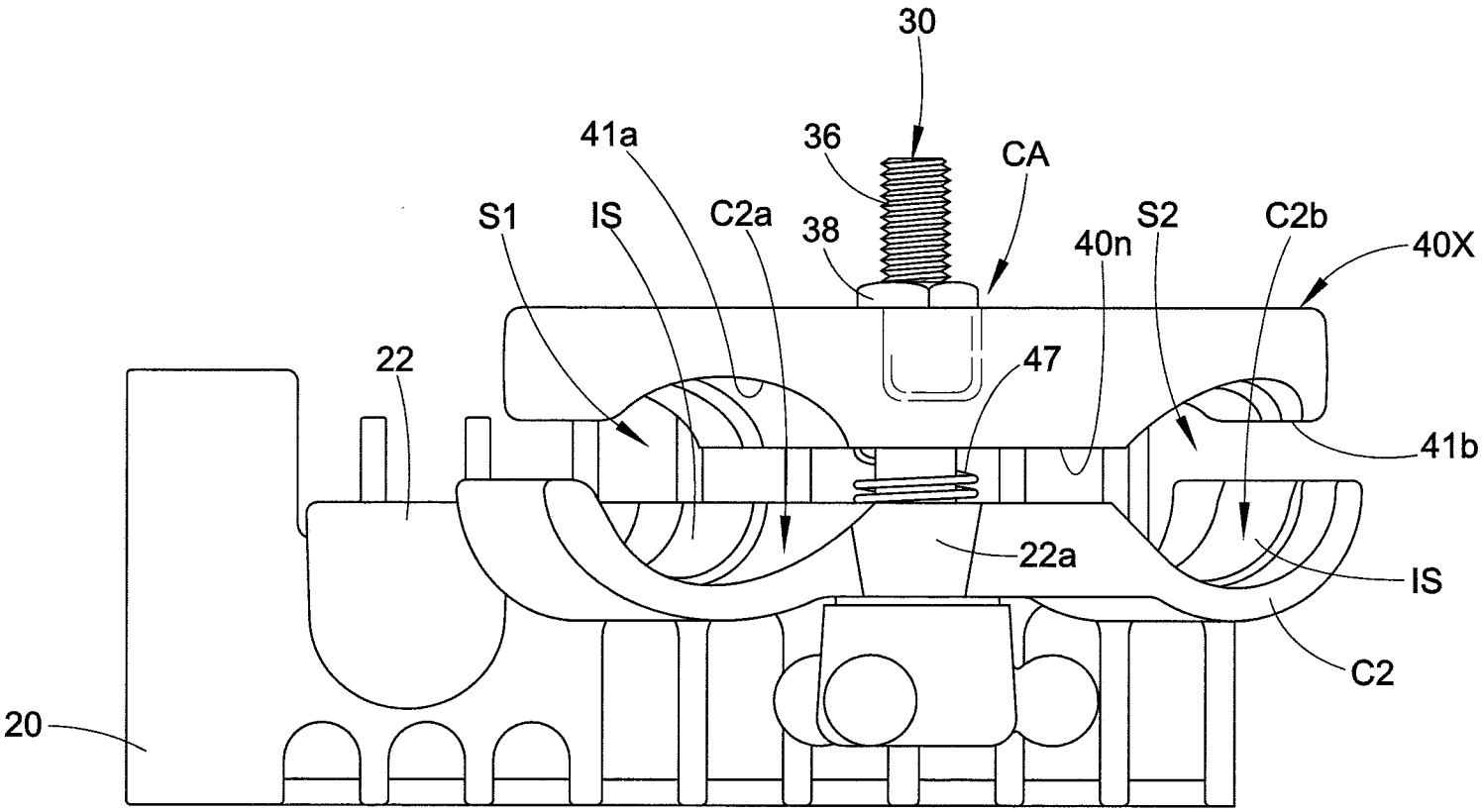
FIG. 4 is a bottom view of the clamp assembly of FIG. 3, with the cable portions removed to better show the structure of the clamp assembly.

FIG. 3 is an isometric view of the clamp chassis C2 of FIGS. 2A and 2B, separated from the module M, and further including a clamp bar or clamp 40 operatively secured thereto to provide a clamp assembly CA in accordance with an embodiment of the present development. FIG. 4 is a bottom view of the clamp assembly of FIG. 3, with the cables CB1,CB2 removed to better show the structure of the clamp assembly CA. The clamp chassis C2 includes a base 20 connected to or adapted to be connected to a wall of the module M, and includes an elongated arm 22 projecting outwardly from the base 20. The first and second cable receiving locations C2*a*,C2*b* are connected to an outer end 22*a* of the arm, and are located on opposite sides of the arm 22 relative to each other. The clamp chassis C2, including the base 20, arm 22 and first and second cable receiving locations C2*a*,C2*b* are preferably constructed as a one-piece metallic structure such as a cast structure, e.g., a zinc die casting.

The outer end 22*a* of the arm 22 includes an aperture 26 (see also FIGS. 2B and 5) defined there through and located between the first and second cable receiving locations C2*a*, C2*b*. The aperture 26 is adapted to receive a clamp fastener 30 which is rotatable in the aperture 26. The fastener 30, shown by itself in FIG. 6, comprises a first end 32 including an enlarged driving head 34 adapted to be manually engaged by a user for rotation of the fastener. The head 34 can additionally or alternatively be adapted for engagement by a tool such as a wrench or screwdriver for user rotation of the fastener 30. The fastener 30 comprises a shank 36 that projects outwardly from the head 34 and that includes threads 36*t*. The shank 36 is defined about and extends axially along a longitudinal axis 36*x*. Between the head 34 and the shank 36, the fastener comprises a shoulder region 35 including a cylindrical outer surface 35*s* and a transverse lock face 35*f* including at least one and preferably a plurality of locking features or projections 35*k* that extend outwardly from the lock face 35*f*. In the illustrated embodiment, the locking features 35*k* comprise a plurality of helical teeth HT each comprising a ramped lock face LF that function as described in more detail below to inhibit unintended rotation of the fastener 30 in a direction that would retract or "loosen" the nut 38 due to shock and vibration.

The clamp fastener 30 is used to secure the clamp 40 in its operative position relative to the clamp chassis C2. In particular, the clamp 40 comprises an elongated bar structure or body including first and second cable receiving recesses 41*a*,41*b* defined in an inner surface 40*n* that faces the clamp chassis C2 and configured to receive an associated cable CB1,CB2 such that the clamp 40 engages each cable CB1, CB2 in a saddle arrangement. In the illustrated embodiment, each cable receiving recess 41*a*,41*b* includes an inner surface comprising a circular arc segment or another curved surface.

Figure 9:
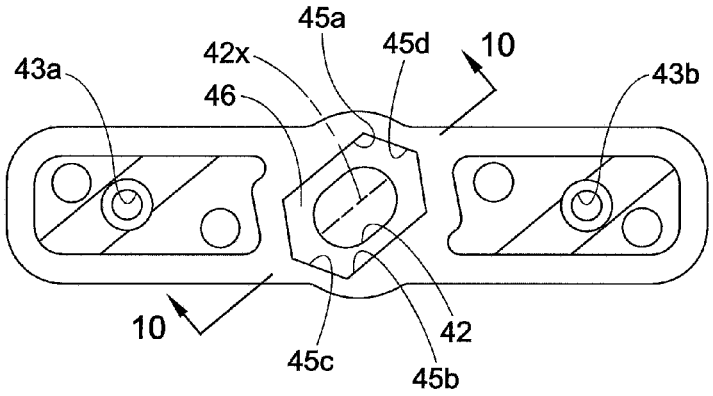
FIG. 9 is a side view of the clamp of the clamp assembly of FIGS. 3 and 4.
Figure 10:
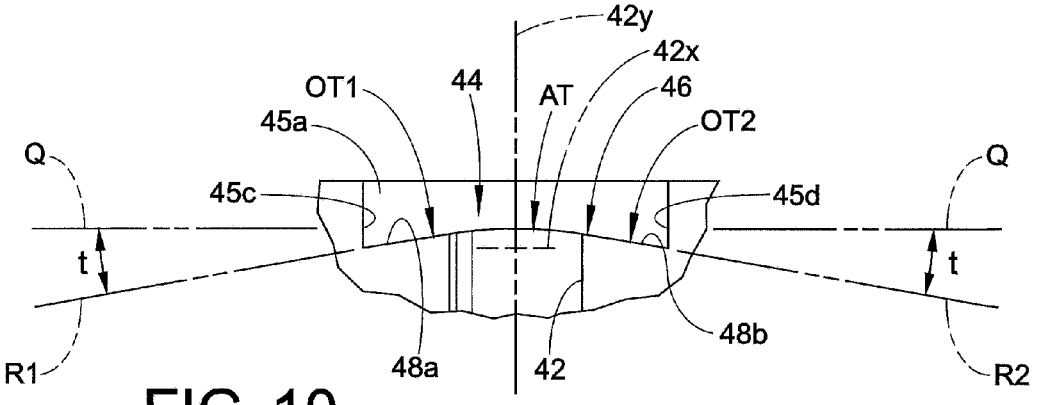
FIG. 10 is a partial section view of the clamp as taken at line 10-10 of FIG. 8.

The clamp 40 is shown separately in FIGS. 9 and 10 and further includes an aperture 42 through which the fastener shank 36 extends located between the first and second cable receiving recesses 41*a*,41*b*, and a nut 38 is threaded on the outer end of the shank to capture the clamp 40 on the shank 36 of the fastener 30. The clamp 40 includes a recess 44 surrounding the aperture 42 in an outer surface 40*x* that is arranged opposite the inner surface 40*n* that faces the clamp chassis C2, and the aperture 42 opens through the recess 44. The nut 38 is at least partially received in the recess 44 and the nut 38 is non-rotatably engaged with the recess 44. The recess 44 includes opposite first and second side walls 45*a*,45*b* between which the nut 38 is closely received with some clearance, and the side walls 45*a*,45*b* restrain/limit rotation of the nut 38 in the recess 44 due to engagement of respective flats of the nut 38 with the side walls 45*a*,45*b* such that the nut is restrained against rotation with the fastener 30 when the fastener is rotated so that rotation of the fastener 30 in a first direction advances (tightens) the nut 38 on the threaded portion of the shank 36, and rotation of the fastener in an opposite second direction retracts (loosens) the nut 38 on the threaded portion of the shank 36. The recess also includes opposite first and second end walls 45*c*,45*d* that connect the opposite ends of the side walls 45*a*,45*b*. The clamp 40 is preferably defined from an electrically conductive material, such as a one-piece metallic casting or other structure, such as a one-piece zinc die casting or other one-piece or fabricated multi-piece metal structure.

In use, as shown in FIG. 3, the clamp 40 is operatively secured to the clamp chassis C2 using the fastener 30 and mating nut 38. When the clamp 40 is positioned in its operative position, the first and second cable receiving recesses 41*a*,41*b* thereof are arranged in opposed spaced-apart facing relation with the first and second cable receiving locations C2*a*,C2*b* of the clamp chassis, respectively, such that respective first and second cable receiving spaces S1,S2 (FIG. 4) are defined there between. The cable receiving spaces S1,S2 are respectively adapted to accommodate and retain the cables CB1,CB2 when the fastener 30 is rotated sufficiently to advance the nut 38 on the threaded shank 36 to a location where the clamp 40 captures the cables CB1, CB2 in the spaces S1,S2 defined between the cable receiving locations C2*a*,C2*b* of the clamp chassis and the cable receiving locations 41*a*,41*b* of the clamp. When the cables CB1,CB2 are operatively secured by the clamp assembly CA as just described, the exposed EMI sheath ES of the first cable CB1 is in contact with and electrically connected to the first cable receiving locations C2*a*,41*a* of the chassis and clamp, and the exposed EMI sheath ES of the second cable CB2 is in contact with and electrically connected to the second cable receiving locations C2*b*,41*b* of the chassis and clamp, such that the sheath ES of each cable CB1,CB2 is electrically connected to a ground path of the module M, which includes the clamp chassis C2. The fastener 30 electrically connects the clamp 40 and clamp chassis C2.

In the illustrated embodiment, the clamp assembly CA comprises a spring 47 that biases the clamp 40 outwardly away from the clamp chassis C2 to facilitate cable insertion and removal from the spaces S1,S2. In one embodiment as shown herein, the spring 47 comprises a coil spring coaxially positioned about the fastener shank 36 and located between the clamp chassis C2 and the clamp 40. Because the spring 47 biases the clamp 40 away from the clamp chassis C2, the nut 38 will be located in the recess 44, even when no cables CB1,CB2 are present, which facilitates one-handed operation of the fastener 30, i.e., the fastener 30 can be rotated and the nut 38 will be restrained against rotation due to its presence in the recess 44. When the fastener 30 is loosened to open the spaces S1,S2 sufficiently to receive the cables CB1,CB2, the cables can be easily inserted because the clamp 40 is maintained spaced-apart from the clamp chassis C2 by the spring 47. Of course, the biasing force of the spring 47 is overcome when the fastener 30 is rotated to advance the nut 38 and draw the clamp 40 toward the clamp chassis C2 and capture the cables CB1,CB2 in the spaces S1,S2, respectively. The fastener threads 36*t* can be deformed or obstructed at the outer end 36*e* of the shank to provide resistance to rotation of the nut 38 in such region, to provide a tactile indication to a user that the nut is located near the outer end 36*e* of the shank to reduce the likelihood that the fastener 30 is completely unthreaded from the nut.

Figure 8:
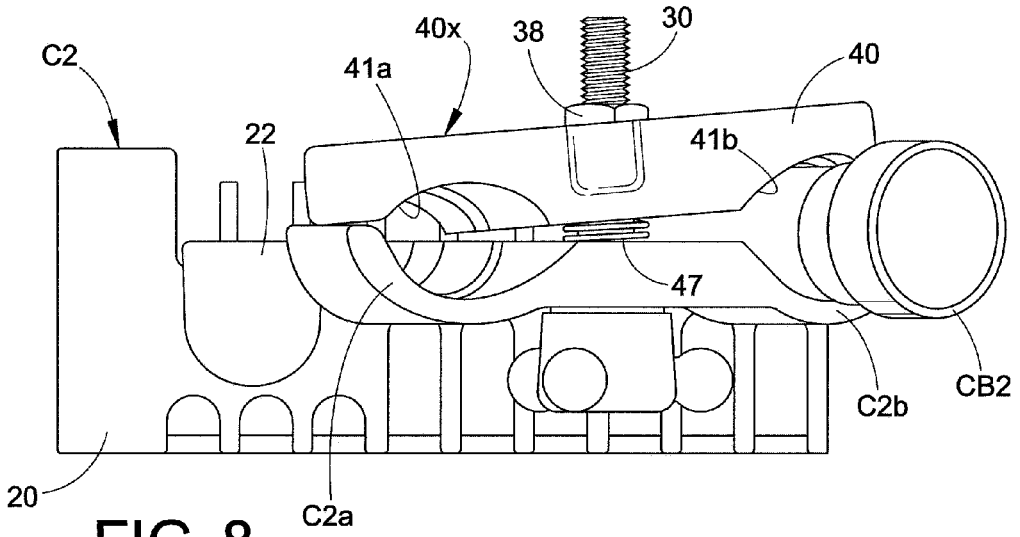
FIG. 8 is a bottom view similar to FIG. 4, but showing a single associate cable operatively secured to the clamp assembly, and showing the clamp pivoted to an offset operative position.

In some cases, such as when the cables CB1,CB2 are different diameters or when one of the cables CB1,CB2 is absent as shown in FIG. 8, the clamp 40 is designed to pivot to an offset operative position where the cable receiving spaces S1,S2 are unequal sizes relative to each other due to pivoting movement of the clamp 40 about the longitudinal axis CX1,CX2 of the larger diameter cable if two cables CB1,CB2 are present, or about the longitudinal axis CX1, CX2 of the single cable if only one cable CB1 or CB2 is being retained by the clamp assembly CA as shown in FIG. 8. To enable the clamp 40 to pivot as shown in FIG. 8 (or to pivot in the opposite direction if the cable CB1 is present and the cable CB2 is absent), the aperture 42 of the clamp 40 is elongated or ovalized, along a major axis 42*x*, and the recess 44, itself, is also elongated along the major axis 42*x*. The aperture 42 extends axially through the clamp 40 between the inner and outer surfaces thereof 40*n*,40*x* along a longitudinal or central axis 42*y*. The major axis 42*x* intersects and is arranged perpendicular to the central axis 42*y* of the aperture 42.

Referring now also to the section view of FIG. 10, the recess 44 includes an inner wall or floor 46 arranged transverse to the side walls 45*a*,45*b* and end walls 45*c*,45*d*. The floor 46 is not planar but, instead comprises first and second offset, angled, or tapered floor surfaces or portions 48*a*,48*b* located on opposite first and second sides of the aperture 42, with the first offset floor portion 48*a* located between the first end wall 45*c* and the aperture 42, and the second offset floor portion 48*b* located between the second end wall 45*d* and the aperture 42. The first and second offset floor portions 48*a*,48*b* are offset by an angle t relative to a reference plane Q that lies tangent to the floor 46 at the intersection of the floor 46 and the aperture 42, with the angle t being measured between the reference plane Q and respective floor planes R1,R2. The floor planes R1,R2 are either respectively coincident with the first and second offset floor portions 48*a*,48*b* if the floor portions 48*a*,48*b* are planar, or the floor planes R1,R2 are respectively tangent with the first and second offset floor portions 48*a*,48*b* if the floor portions 48*a*,48*b* are curved. As such, the first and second offset floor surfaces 48*a*,48*b* are spaced from the reference plane Q a greater distance when measured adjacent the respective first and second end walls 45*c*,45*d* as compared to when measured adjacent the aperture 42, with the distance equal to zero at the intersection of the aperture 42 with the floor 46. Thus, a respective distance defined between the first and second offset floor surfaces 48*a*,48*b* and the outer surface 40*x* of the clamp 40 increases as the first and second offset floor surfaces 48*a*,48*b* extend away from said central axis 42*y* of said clamp aperture 42 along said major axis 42*x*. The region of the floor surrounding and adjacent the aperture 42 defines and provides a primary axial thrust surface AT, and the first and second offset floor portions 48*a*,48*b* define and provide first and second offset thrust surfaces OT1,OT2.

Figure 11B:
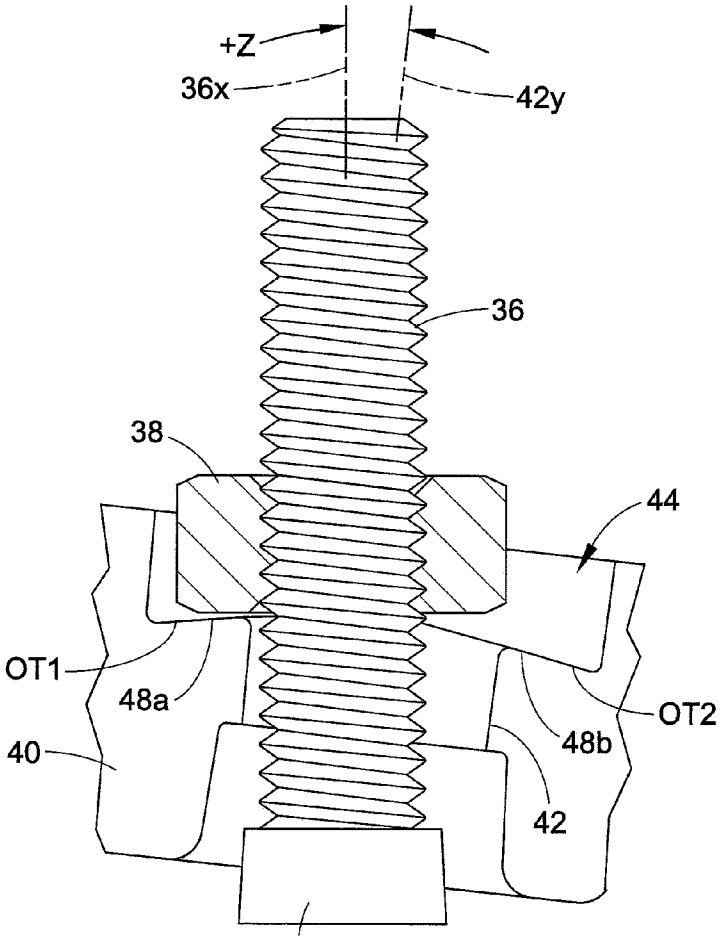
FIGS. 11A and 11B diagrammatically show the clamp in its first and second angularly offset positions relative to the fastener and nut of the clamp assembly, respectively.
Figure 11A:
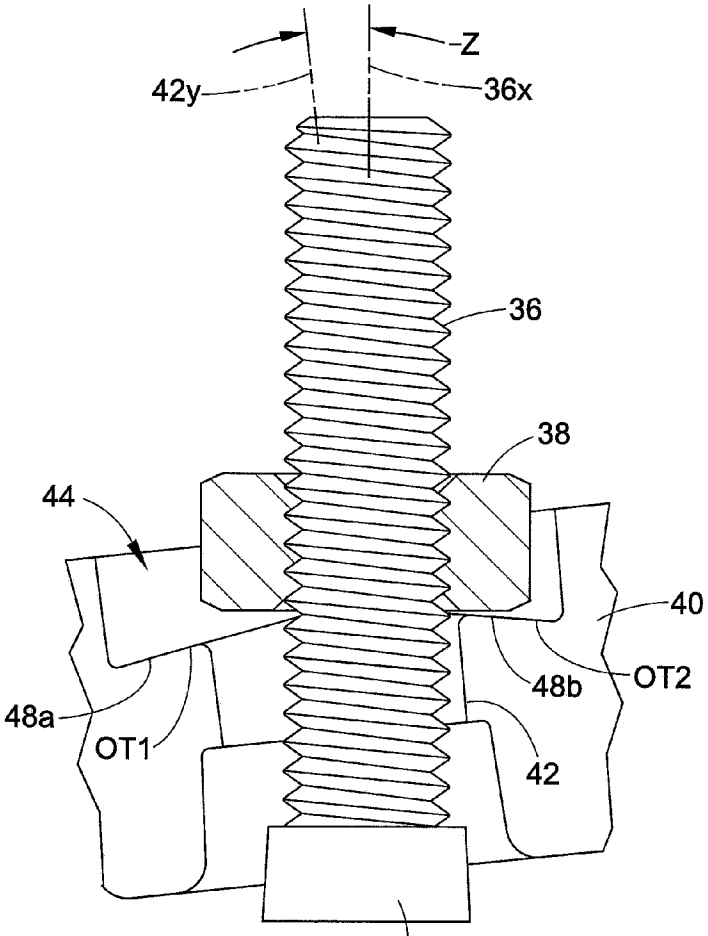

FIGS. 11A and 11B diagrammatically show the clamp 40 in its first and second angularly offset positions relative to the fastener shank 36 and nut 38, respectively. More particularly, FIG. 11A corresponds to FIG. 8 and shows the clamp 40 pivoted about the longitudinal axis CX2 of the cable CB2 to a first angularly offset position. As such, a clamp offset angle −z is defined between the longitudinal axis 36*x* of the fastener shank 36 and the central axis 42*y* of the clamp aperture 42, and the nut 38 is abutted with the second offset thrust surface OT2. FIG. 11B illustrates an opposite arrangement relative to FIG. 11A in which the clamp 40 is pivoted about the longitudinal axis CX1 of the first cable CB1 to a second angularly offset position when the second cable CB2 is absent (the first and second cables are not shown in FIGS. 11A and 11B). In FIG. 11B, a clamp offset angle +z is defined between the longitudinal axis 36*x* of the fastener shank 36 and the central axis 42*y* of the clamp aperture 42, and the nut 38 is abutted with the first offset thrust surface OT1. Those of ordinary skill in the art will recognize that the elongated aperture 42 and elongated recess 44 allow the clamp 40 to move relative to the fastener shank 36 and nut 38 to the first and second angularly offset positions without bending stresses being exerted on the shank 36 and threads thereof, and the first and second offset thrust surfaces OT1,OT2 are oriented such that the nut 38 exerts thrust forces on clamp 40 and opposite reaction forces on the shank 36 that are both coincident with the longitudinal axis 36*x* of the fastener shank 36. This elimination bending stress on the fastener shank 36 increases the durability of the fastener 36 and allows the fastener 36 to be made less robust and using less expensive material such as zinc or another suitable low-cost material.

Figure 5:
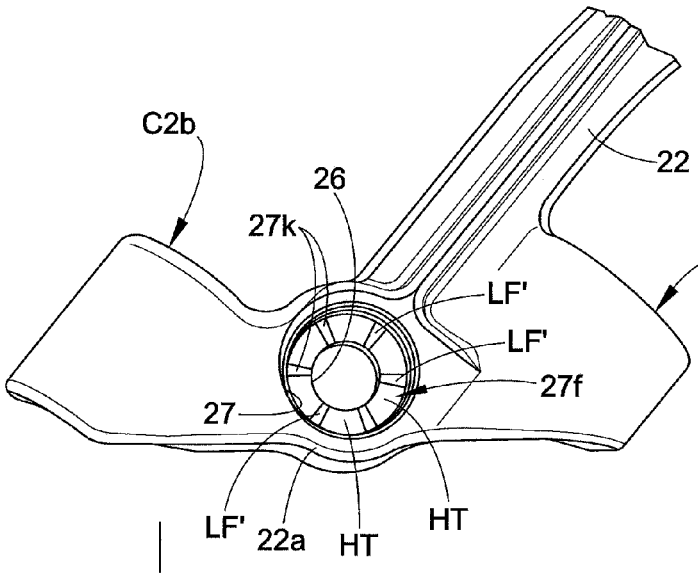
FIG. 5 is a partial left side view if the chassis of FIG. 2A as taken at line 5-5 of FIG. 2A showing the chassis fastener locking features in accordance with the present development.
Figure 6:
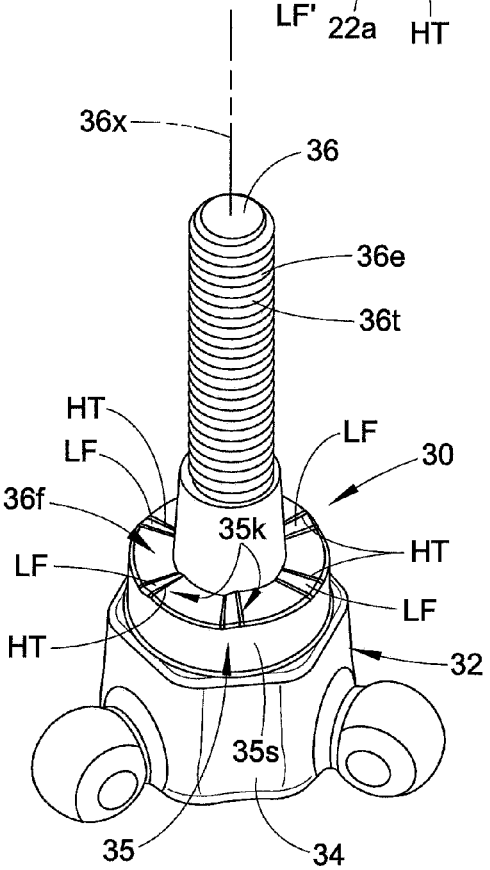
FIG. 6 is a greatly enlarged isometric view of the fastener of the clamp assembly of FIGS. 3 and 4 showing the locking features of the fastener.

As noted above, the fastener 30 preferably comprises locking features 35*k* that engage and coact with the clamp chassis C2 to inhibit unintended rotation of the fastener 30 in a direction (counter-clockwise in the present example) that would cause the nut 38 to retract or "loosen" on the shank 36. In this regard, as shown in FIG. 5, the aperture 26 of the clamp chassis C2 includes a counter bore 27 comprising a transverse face 27*f* including a plurality of including at least one and preferably a plurality of locking features or projections 27*k* that extend outwardly from the lock face 27*f*. In the illustrated embodiment, the locking features 27*k* correspond to the fastener locking features 35*k* and thus comprise a plurality of helical teeth HT each comprising a ramped lock face LF', wherein the lock faces LF,LF' are oriented so that they will lie parallel to and abut each other when the shoulder region 35 of the fastener 30 is received in the counter bore 27 when the fastener 30 is operatively installed in the aperture 26 of the clamp chassis C2. The abutted lock faces 27,27' will inhibit rotation of the fastener 30 in a direction that would cause the nut 38 to retract or "loosen" on the shank 36. Alternative projecting locking features 27*k*,35*k* are contemplated and the present development is not to be limited to the illustrated embodiment.

Figure 7:
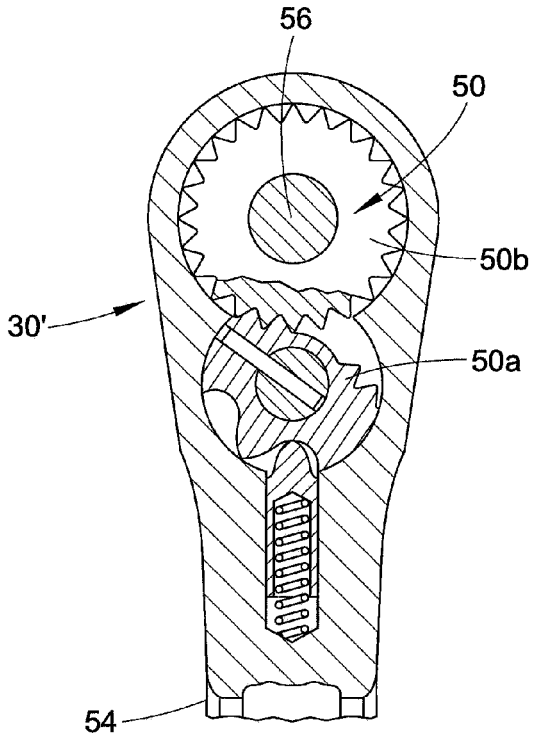
FIG. 7 is a section view that illustrates an alternative fastener including a ratchet mechanism to facilitate tightening and loosening of the fastener without requiring additional tools.

FIG. 7 is a section view of an alternative embodiment of the fastener 30' which includes a ratchet mechanism 50. The fastener 30' comprises a handle 54 adapted to be grasped by a user to rotate the threaded shank 56 in a first direction or a second direction to advance (tighten) or retract (loosen) the nut 38. The handle 54 is operatively connected to the shank 36 by the ratchet mechanism 50 including a pawl 50*a* and ratchet wheel 50*b*, wherein the ratchet wheel 50*b* is connected to the shank 56 such that the shank 56 rotates with the ratchet wheel 50*b*. The pawl 50*a* is manually moved between first and second operative positions where it engages the ratchet wheel 50*b* in first and second orientations to allow torque to be transmitted from the handle 54 to the ratchet wheel 50*b* in first and second directions, respectively, and allows freewheeling of the handle 54 relative to the ratchet wheel 50*b* in the opposite direction. Further details of the ratchet mechanism are described in U.S. Pat.

Figure 12:
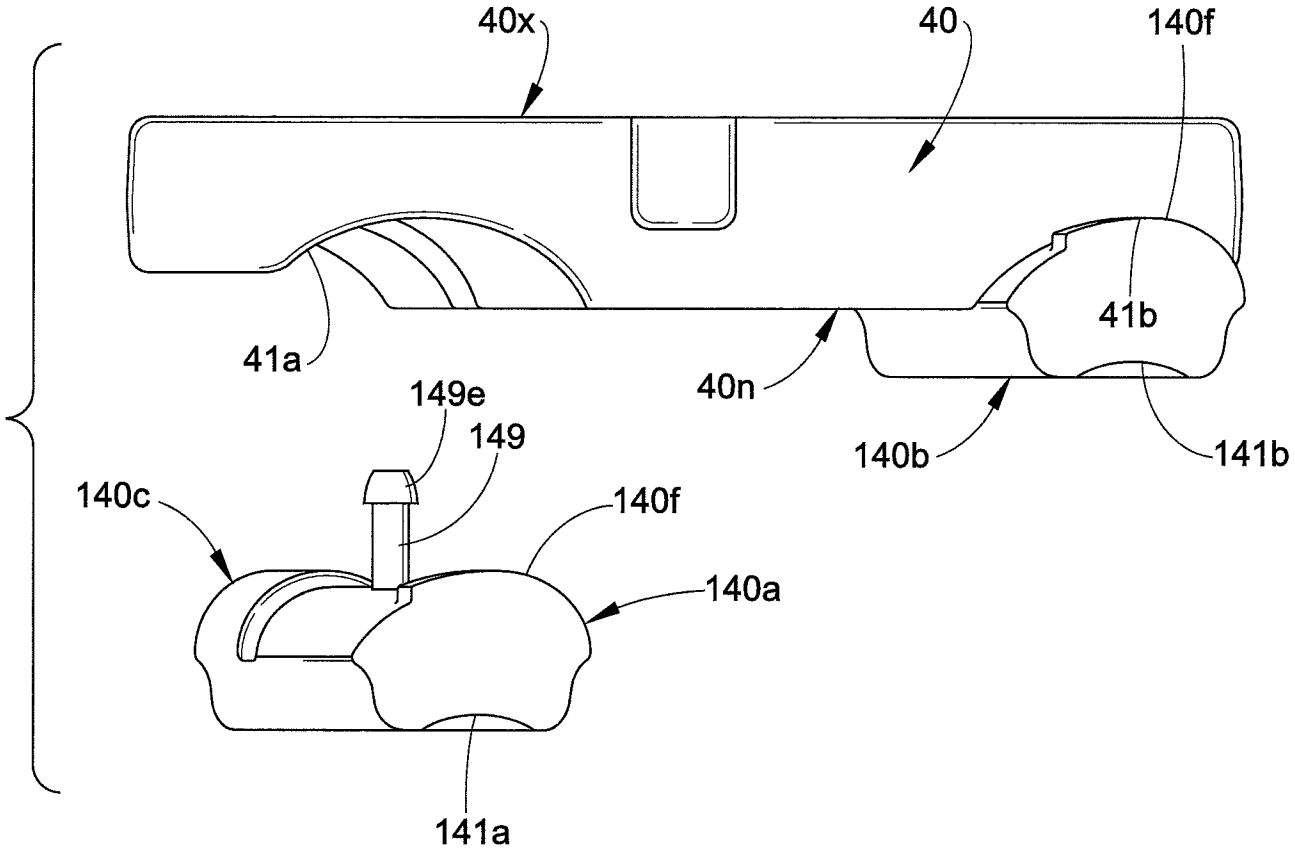
FIGS. 12 and 13 provide respective bottom and isometric views of the clamp of FIG. 9, further including a first cable size adapter operatively secured thereto and showing a second cable size adapter in an exploded condition relative to the clamp bar.
Figure 13:
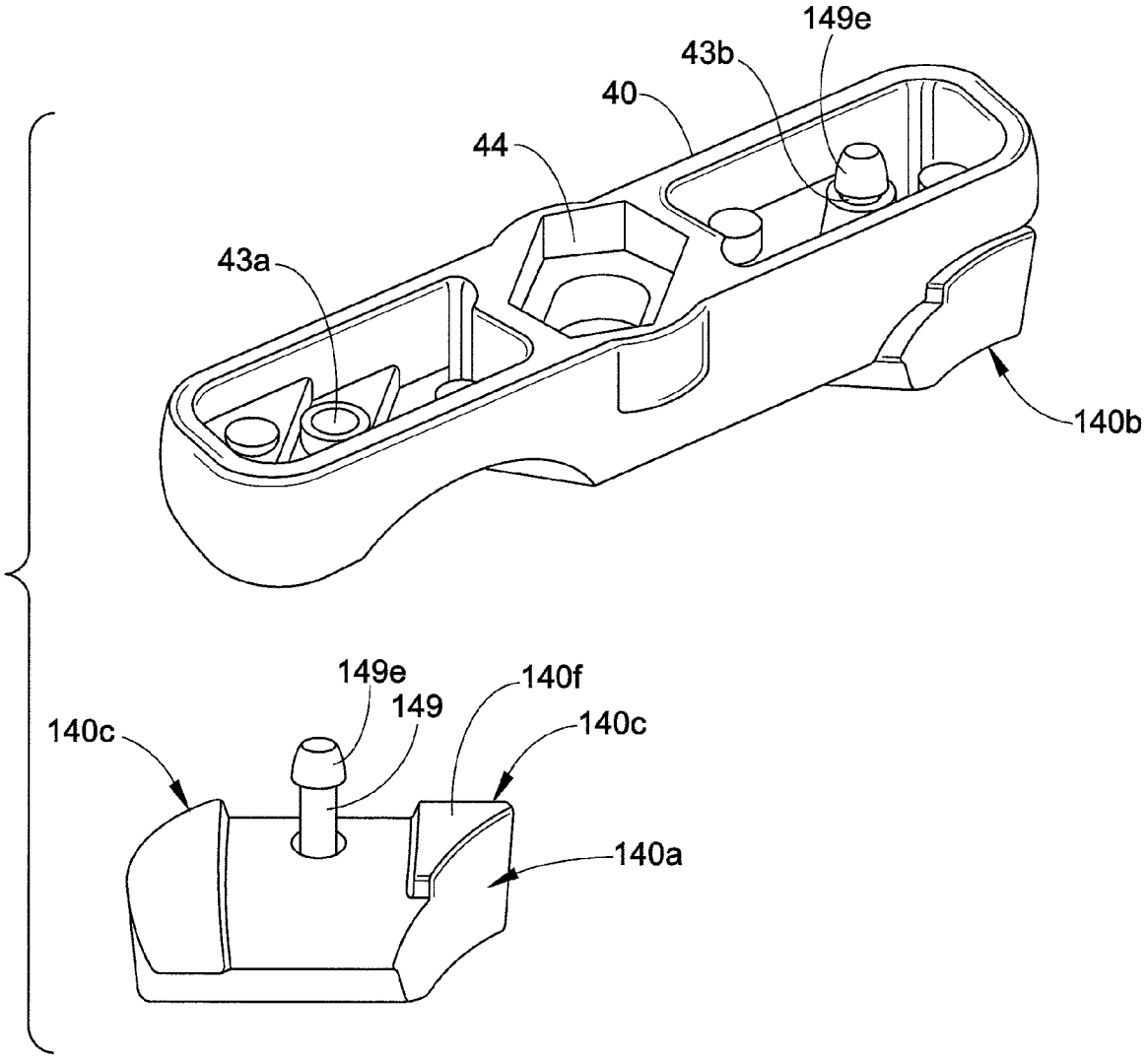

No. 1,957,462, the entire disclosure of which is hereby expressly incorporated by reference into the present specification FIGS. 12 and 13 provide respective bottom and isometric views of the clamp 40, and further illustrate the structure and function of first and second cable size adapters 140*a*,140*b* that can be used together or individually as needed. The cable size adapters 140*a*,140*b* are identical to each other and are adapted to be selectively received in the first and second cable receiving locations 41*a*,41*b* of the clamp 40, with their respective inner faces 140*f* abutted with the cable receiving locations 41*a*,41*b*. The cable size adapters 140*a*,140*b* include outer faces located opposite the inner face 140*f* comprising respective concave cable receiving locations 141*a*,141*b* that are oriented outwardly away from and that are spaced outwardly from the cable receiving locations 41*a*,41*b* when the adapters 140*a*,140*b* are operatively installed on the clamp 40. When operatively connected/installed on the clamp 40 (as shown for the cable size adapter 140*b*), the cable size adapters 140*a*,140*b* partially fill and reduce the size of the cable receiving spaces S1,S2 defined between the first and second cable receiving locations C2*a*,C2*b* of the clamp chassis C2 and the clamp 40 to ensure that a smaller diameter cable is tightly engaged between the cable size adapters 140*a*,140*b* of the clamp 40 and the clamp chassis C2. In particular, the sheath ES of a smaller diameter cable will be abutted with the inner surface IS of the cable receiving locations C2*a*,C2*b* of the clamp chassis 40 on one side and will be abutted with the cable receiving locations 141*a*,141*b* of the adapters 140*a*,140*b* on the opposite side. The presence of the adapters 140*a*,140*b* ensures that the nut 38 can be advanced sufficiently on the fastener shank 36 to locate the clamp 40 where the cables will be tightly captured in the cable receiving spaces S1,S2 before the clamp 40 abuts the clamp chassis C2 or is otherwise prevented from moving closer to the clamp chassis C2.

The first and second cable size adapters 140*a*,140*b* are selectively connected to and disconnected from the clamp 40 as needed, without requiring any tools. In the illustrated embodiment, the clamp 40 comprises first and second mounting holes 43*a*,43*b* (see also FIG. 9) that open into the first and second cable receiving locations 41*a*,41*b*. Each adapter 140*a*,140*b* includes a post 149 with an enlarged outer end 149*e* projecting outwardly from its inner face 140*f*. The post 149 is adapted to be inserted into one of the mounting holes 43*a*,43*b* and the enlarged outer end 149*e* engages the clamp 40 with a snap-fit or otherwise such that the cable size adapter 140*a*,140*b* is captured to the clamp 40 with the inner surface 140*f* abutted with the respective cable receiving location 41*a*,41*b*. The inner surface 140*f* of each cable size adapter 140*a*,140*b* is curved such that it defines a cam surface 140*c*. To separate the cable size adapter 140*a*, 140*b* from the clamp 40, the cable size adapter is twisted relative to the clamp 40 such that the post 149 rotates in the hole 43*a*,43*b*, which causes the cam surface 140*c* to engage the cable receiving location 41*a*,41*b* of the clamp with a cam action that urges the cable size adapter 140*a*,140*b* outwardly away from the clamp 40 and out of the cable receiving location sufficiently such that the enlarged end 149*e* of the post is disengaged from the clamp 40 and the adapter 140*a*,140*b* can be manually separated from the clamp.

In the preceding specification, various embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

The invention claimed is:

1. An electronics module comprising:

left and right side walls and a bottom wall that extends between the left and right side walls;

an electrically conductive cable clamp chassis projecting outward from the bottom wall of the module, said cable clamp chassis defined as a one-piece metallic structure comprising first and second cable mounting locations adapted to receive respective first and second associated cables, said first and second cable mounting locations arranged in a zero stack configuration in which the first and second cable mounting locations are centered on a common reference plane (P) that lies between and parallel to the left and right side walls of the electronics module such that the respective longitudinal axes of the first and second associated cables are both located within said reference plane (P) between said left and right side walls of the module, wherein said first and second cable mounting locations each comprise an axially extending circular arc segment surface bisected by said reference plane (P);

first and second cable clamps secured to said cable clamp chassis respectively adjacent said first and second cable mounting locations and respectively adapted to secure the first and second associated cables in the first and second cable mounting locations with an EMI shield of each associated cable electrically connected to said cable clamp chassis.

2. The electronics module as set forth in claim 1, wherein said reference plane (P) is situated midway between the left and right sidewalls of the electronics module.

3. An electronics module comprising:

a cable clamp chassis projecting outward from a wall of the module, said cable clamp chassis comprising a one-piece metallic structure including first and second cable mounting locations adapted to receive respective first and second associated cables, said first and second cable mounting locations each comprising an axially extending recess located adjacent a first reference plane (P) in which respective longitudinal axes of the first and second associated cables lie, and each of said first and second cable mounting locations comprising an inner surface including an innermost point that lies tangent to a second reference plane (P2) that is parallel to and offset from the first reference plane P such that the first and second cables are arranged in a zero stack configuration;

a clamp secured to said cable clamp chassis and adapted to secure the first and second associated cables in the first and second cable mounting locations.

4. The electronics module as set forth in claim 3, wherein the second plane (P2) is offset from the first reference plane (P) by a distance equal to half a maximum diameter of the first and second associated cables such that the longitudinal axis of each of the first and second associated cables will be located in the first reference plane (P).

5. The electronics module as set forth in claim 3, wherein said cable clamp chassis comprises:

a base connected to a wall of said electronics module;

an elongated arm projecting outwardly from the base, wherein the first and second cable mounting locations are connected to an outer end of the arm and are located on opposite sides of the arm, and wherein the outer end of the arm comprises an aperture defined therein and located between the first and second cable mounting locations.

6. The electronics module as set forth in claim 5, wherein:

the clamp comprises an elongated bar structure including first and second cable receiving recesses defined in an inner surface of the clamp and including an aperture located between the first and second cable receiving recesses; and said electronics module further comprises:

a fastener that extends through said aperture defined in said arm of said clamp chassis and through said aperture defined in said clamp;

a nut engaged with the fastener such that said fastener and nut capture said clamp to said clamp chassis with said first and second cable receiving recesses of said clamp located in opposed facing relation with said first and second cable mounting locations, respectively, such that a first cable receiving space is defined between the first cable receiving recess of the clamp and the first cable mounting location of the clamp chassis and a second cable receiving space is defined between the second cable receiving recess of the clamp and the second cable mounting location of the clamp chassis, said first and second cable receiving spaces respectively adapted to accommodate and retain the first and second associated cables, with an EMI shield of each first and second associated cable electrically connected to said cable clamp chassis.

7. The electronics module as set forth in claim 6, wherein the fastener electrically connects the clamp to the clamp chassis.

8. The electronics module as set forth in claim 6, wherein said clamp comprises a recess located in an outer surface and into which said aperture of said clamp opens, and wherein said nut is located in said recess and restrained against rotation with said fastener.

9. The electronics module as set forth in claim 8, wherein:

said aperture of said clamp is defined about a central axis that intersects inner and outer surfaces of said clamp;

said aperture and said recess are both elongated along a major axis that intersects said central axis of said clamp aperture.

10. The electronics module as set forth in claim 9, wherein:

said recess comprises a floor including first and second tapered floor surfaces respectively located on opposite first and second sides of said clamp aperture;

a respective distance defined between said first and second floor surfaces and said outer surface of said clamp increases as said first and second floor surfaces extend away from said central axis of said clamp aperture along said major axis;

a region of the floor surrounding and adjacent the clamp aperture provides a primary axial thrust surface oriented perpendicular to the central axis of the clamp aperture, and the first and second offset floor surfaces respectively provide first and second offset thrust surfaces that are angled in respective first and second directions relative to the central axis of the clamp aperture.

11. The electronics module as set forth in claim 10, wherein:

the fastener comprises a shank that extends along a longitudinal axis, and wherein the clamp is movable to:

a first angularly offset position wherein a first clamp offset angle (−z) is defined between the longitudinal axis of the fastener shank and the central axis of the clamp aperture, and in which the nut is abutted with the second offset thrust surface;

a second angularly offset position wherein a second clamp offset angle (+z) is defined between the longitudinal axis of the fastener shank and the central axis of the clamp aperture, and in which the nut is abutted with the first offset thrust surface.

12. The electronics module as set forth in claim 6, wherein:

said aperture of said clamp chassis comprises a counterbore including a transverse face comprising a plurality of locking projections; and, said fastener comprises a plurality of locking projections that engage said locking projections of said transverse face of said counterbore to inhibit rotation of said fastener relative to said clamp chassis.

13. The electronics module as set forth in claim 12, wherein said locking projections of said transverse face of said counterbore and said locking projections of said fastener each comprise a plurality of locking teeth each comprising a ramped lock face.

14. The electronics module as set forth in claim 6, wherein said fastener comprises a ratchet mechanism including a pawl and a ratchet wheel, wherein said ratchet wheel is connected to a threaded shank of said fastener and said pawl transmits torque to said ratchet wheel from a handle of said fastener, wherein said pawl is selectively movable between first and second operative positions for transmission of torque from said handle to said ratchet wheel in respective first and second directions.

15. The electronics module as set forth in claim 6, further comprising at least one cable size adapter connected to said clamp adjacent at least one of said first and second cable receiving recesses, said at least one cable size adapter comprising an inner face abutted with said clamp and an outer face defining a concave cable receiving location adapted to contact one of the first and second associated cables, wherein said at least one cable size adapter is selectively connected to and disconnected from the clamp.

16. The electronics module as set forth in claim 15, wherein said clamp comprises first and second mounting holes that open respectively into the first and second cable receiving locations of the clamp, and wherein the at least one cable size adapter comprises a post projecting outwardly therefrom that is releasably engaged with one of the first and second mounting holes of the clamp.

17. The electronics module as set forth in claim 16, wherein the at least one cable size adapter comprises an inner face that is abutted with said clamp and that defines a curved cam surface that urges said cable size adapter away from said clamp when said cable size adapter is twisted relative to said clamp.

18. The electronics module as set forth in claim 6, further comprising a spring coaxially positioned about said fastener and located between said clamp chassis and said clamp for biasing said clamp away from said clamp chassis.

19. An electronics module comprising:

a cable clamp chassis projecting outward from a wall of the module, said cable clamp chassis comprising first and second cable mounting locations adapted to receive respective first and second associated cables, said first and second cable mounting locations each comprising an axially extending recess located adjacent a first reference plane (P) in which respective longitudinal axes of the first and second associated cables lie, and each of said first and second cable mounting locations comprising an inner surface including an innermost point that lies tangent to a second reference plane (P2) that is parallel to and offset from the first reference plane P such that the first and second cables are arranged in a zero stack configuration, wherein the second plane (P2) is offset from the first reference plane (P) by a distance equal to half a maximum diameter of the first and second associated cables such that the longitudinal axis of each of the first and second associated cables will be located in the first reference plane (P), wherein said cable clamp chassis comprises:

a base connected to a wall of said electronics module;

an elongated arm projecting outwardly from the base, wherein the first and second cable mounting locations are connected to an outer end of the arm and are located on opposite sides of the arm, and wherein the outer end of the arm comprises an aperture defined therein and located between the first and second cable mounting locations;

a clamp secured to said cable clamp chassis and adapted to secure the first and second associated cables in the first and second cable mounting locations, wherein the clamp comprises an elongated bar structure including first and second cable receiving recesses defined in an inner surface of the clamp and including an aperture located between the first and second cable receiving recesses;

said electronics module further comprising:

a fastener that extends through said aperture defined in said arm of said clamp chassis and through said aperture defined in said clamp;

a nut engaged with the fastener such that said fastener and nut capture said clamp to said clamp chassis with said first and second cable receiving recesses of said clamp located in opposed facing relation with said first and second cable mounting locations, respectively, such that a first cable receiving space is defined between the first cable receiving recess of the clamp and the first cable mounting location of the clamp chassis and a second cable receiving space is defined between the second cable receiving recess of the clamp and the second cable mounting location of the clamp chassis, said first and second cable receiving spaces respectively adapted to accommodate and retain the first and second associated cables, with an EMI shield of each first and second associated cable electrically connected to said cable clamp chassis.

* * * * *